US008699918B2

(12) United States Patent
Kanai et al.

(10) Patent No.: US 8,699,918 B2
(45) Date of Patent: Apr. 15, 2014

(54) FIXING DEVICE AND IMAGE FORMING APPARATUS

(75) Inventors: Kenji Kanai, Kanagawa (JP); Yasuyuki Kobayashi, Kanagawa (JP); Masakatsu Eda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 13/416,823

(22) Filed: Mar. 9, 2012

(65) Prior Publication Data

US 2013/0011160 A1 Jan. 10, 2013

(30) Foreign Application Priority Data

Jul. 7, 2011 (JP) ..... 2011-151132

(51) Int. Cl.
*G03G 15/20* (2006.01)

(52) U.S. Cl.
USPC ..... 399/122; 399/328

(58) Field of Classification Search
USPC ..... 399/122, 126, 320, 328, 329, 330, 335, 399/338
See application file for complete search history.

(56) References Cited

U.S. PATENT DOCUMENTS

| | | | | |
|---|---|---|---|---|
| 6,411,785 | B1 | 6/2002 | Ogawahara et al. | |
| 7,706,707 | B2 * | 4/2010 | Minakuchi et al. | 399/67 |
| 2008/0219728 | A1 * | 9/2008 | Lee et al. | 399/330 |
| 2009/0087202 | A1 * | 4/2009 | Hurst et al. | 399/45 |
| 2010/0327522 | A1 | 12/2010 | Seike et al. | |
| 2011/0142507 | A1 * | 6/2011 | Sasaki et al. | 399/331 |

FOREIGN PATENT DOCUMENTS

| | | | |
|---|---|---|---|
| JP | 3736240 | B2 | 1/2006 |
| JP | 2011-006249 | A | 1/2011 |

* cited by examiner

*Primary Examiner* — Clayton E LaBalle
*Assistant Examiner* — Victor Verbitsky
(74) *Attorney, Agent, or Firm* — Sughrue Mion, PLLC

(57) ABSTRACT

A fixing device includes a fixing member that is rotated by a driving unit and that fixes a developer image on a recording medium; an external heating member that is driven and rotated while contacting an outer peripheral surface of the fixing member, and that heats the fixing member; a moving unit that moves the external heating member between a separation position and a contact position, and that moves the external heating member from the separation position to the contact position after starting the fixing by the fixing member; a drive transmitting mechanism including a fixing-side gear, an external-heating-member-side gear, and a drive transmitting member; and a driving force transmitting/non-transmitting unit that is provided at the drive transmitting mechanism.

7 Claims, 11 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2011-151132 filed Jul. 7, 2011.

BACKGROUND

Technical Field

The present invention relates to a fixing device and an image forming apparatus.

SUMMARY

According to an aspect of the invention, there is provided a fixing device including a fixing member that is rotated by a driving unit and that fixes a developer image on a recording medium; an external heating member that is driven and rotated while contacting an outer peripheral surface of the fixing member, and that heats the fixing member; a moving unit that moves the external heating member between a separation position, where the external heating member is separated from the outer peripheral surface of the fixing member, and a contact position, where the external heating member contacts the outer peripheral surface of the fixing member, the moving unit moving the external heating member from the separation position to the contact position after starting the fixing by the fixing member; a drive transmitting mechanism including a fixing-side gear, an external-heating-member-side gear, and a drive transmitting member that transmits a driving force between the fixing-side gear and the external-heating-member-side gear, the external-heating-member-side gear being provided at the external heating member; and a driving force transmitting/non-transmitting unit that is provided at the drive transmitting mechanism, the driving force transmitting/non-transmitting unit transmitting the driving force from the fixing-side gear to the external-heating-member-side gear so that the external heating member rotates when the external heating member is at the separation position, the driving force transmitting/non-transmitting unit not transmitting the driving force from the fixing-side gear to the external-heating-member-side gear so that the external heating member is driven and rotated by the fixing member when the external heating member is at the contact position.

BRIEF DESCRIPTION OF THE DRAWINGS

Exemplary embodiments of the present invention will be described in detail based on the following figures, wherein.

DETAILED DESCRIPTION

A fixing device and an image forming apparatus according to exemplary embodiments of the present invention will be described.

Overall Structure

First, an overall structure of the image forming apparatus will be described.

Figure 1:
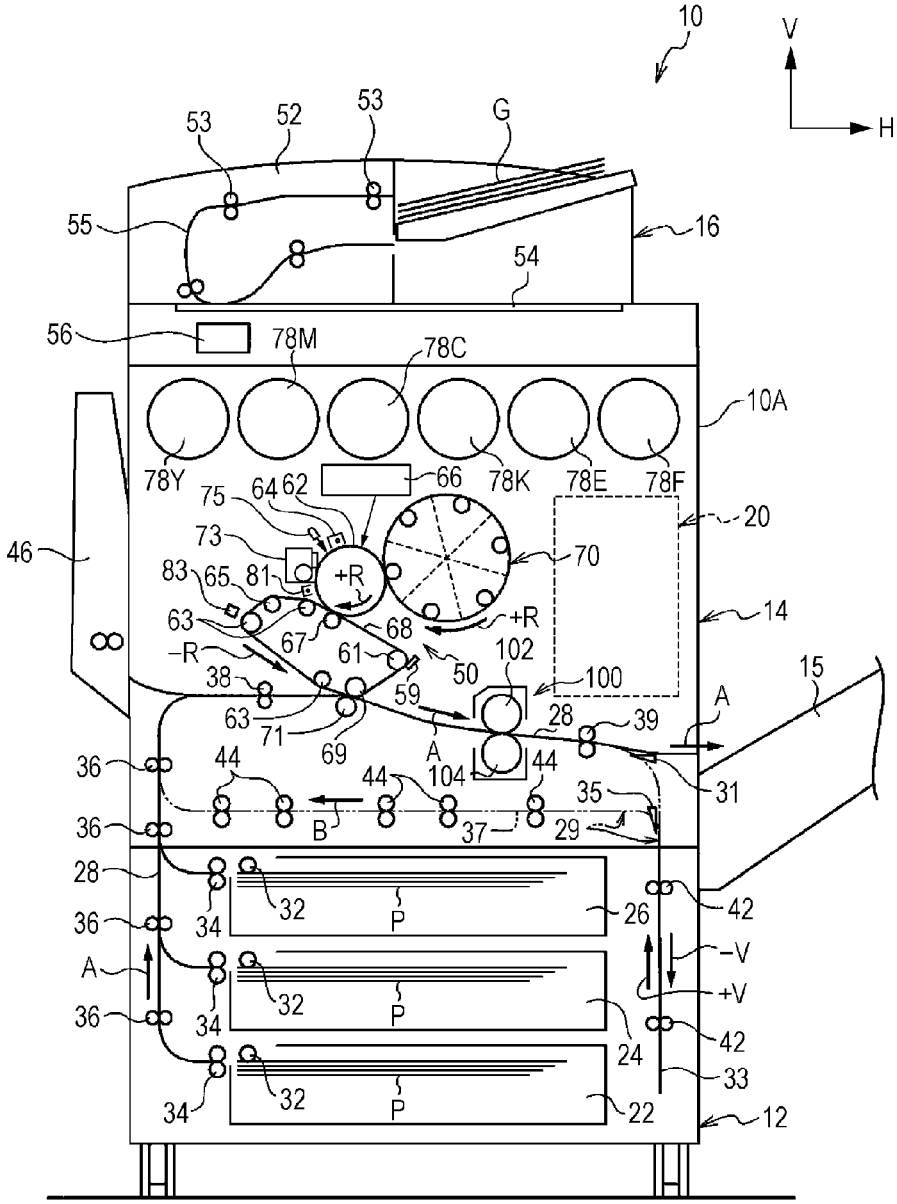
FIG. 1 shows an overall structure of an image forming apparatus according to an exemplary embodiment of the present invention.

An image forming apparatus 10 serving as an exemplary image forming apparatus is shown in FIG. 1. The image forming apparatus 10 includes a sheet holding section 12, an image forming section 14, a document reading section 16, and a controller 20 in a vertical direction (the direction of arrow V) from a lower side to an upper side. The sheet holding section 12 holds pieces of recording paper P. The image forming section 14 is provided above the sheet holding section 12, and forms an image on a piece of recording paper P serving as an exemplary recording medium that is supplied from the sheet holding section 12. The document reading section 16 is provided above the image forming section 14, and reads a reading document G. The controller 20 is provided in the image forming section 14, and controls the operation of each portion of the image forming apparatus 10. In the description below, the vertical direction of an apparatus body 10A of the image forming apparatus 10 corresponds to the direction of arrow V, and a horizontal direction thereof corresponds to the direction of arrow H.

The sheet holding section 12 includes a first holding section 22, a second holding section 24, and a third holding section 26, which hold pieces of recording paper P having different sizes. Delivery rollers 32 that deliver the held pieces of recording paper P into a transport path 28 provided in the image forming apparatus 10 are provided at the first holding section 22, the second holding section 24, and the third holding section 26. Pairs of transport rollers 34 and pairs of transport rollers 36 that transport the pieces of recording paper P one at a time are provided downstream from the delivery rollers 32 in the transport path 28. Aligning rollers 38 that temporarily stop the pieces of recording paper P and that deliver the pieces of recording paper P to a second transfer position QB (described later; see FIG. 2) at a set timing are provided downstream from the transport rollers 36 in a direction of transport of the pieces of recording paper P in the transport path 28.

As viewed from the front of the image forming apparatus 10, an upstream-side portion of the transport path 28 is linearly provided from the left side of the sheet holding section 12 to a lower portion of the left side of the image forming section 14 in the direction of arrow V. A downstream-side portion of the transport path 28 is provided from the lower portion of the left side of the image forming section 14 up to a sheet-discharge section 15 provided on the right side of the image forming section 14. A two-side transport path 29 that transports and reverses a piece of recording paper P for forming images on both sides of the piece of recording paper P is connected to the transport path 28.

As seen from the front of the image forming apparatus 10, the two-side transport path 29 is provided with a first switching member 31, a reversing section 33, a transport section 37, and a second switching member 35. The first switching member 31 switches between the transport path 28 and the two-side transport path 29. The reversing section 33 is linearly provided from a lower portion of the right side of the image forming section 14 to the right side of the sheet holding section 12 in the direction of arrow V (a downward direction is indicated by −V and an upward direction is indicated by +V in the FIG. 1). A rear edge of a piece of recording paper P transported to the reversing section 33 enters the transport section 37, and the piece of recording paper P is transported to the left in FIG. 1 on the basis of the direction of arrow H. The second switching member 35 switches between the reversing section 33 and the transport section 37. Pairs of transport rollers 42 are provided at the reversing section 33 so as to be spaced apart from each other. Pairs of transport rollers 44 are provided at the transport section 37 so as to be spaced apart from each other.

The first switching member 31 is a triangular columnar member. When an end portion of the first switching member 31 is moved to either one of the transport path 28 and the two-side transport path 29 by a driving unit (not shown), the first switching member 31 switches the direction of transport of the recording paper P. The second switching member 35 is similarly a triangular columnar member when viewed from the front side. When an end portion of the second switching member 35 is moved to either one of the reversing section 33 and the transport 37 by a driving unit (not shown), the second switching member 35 switches the direction of transport of the recording paper P. A downstream-side end portion of the transport section 37 is connected to a near side of the transport rollers 36, disposed at the upstream-side portion of the transport path 28, by a guide member (now shown). A folding manual paper feed section 46 is provided at a left surface of the image forming section 14. A transport path of a piece of recording paper P that is transported from the manual paper feed section 46 is connected to a near side of the aligning rollers 38 at the transport path 28.

The document reading section 16 includes a document transport device 52, a platen glass 54, and a document reading device 56. The document transport device 52 automatically transports reading documents G one at a time. The platen glass 54 is disposed at a lower side of the document transport device 52. One reading document G is placed on the platen glass 54. The document reading device 56 reads a reading document G transported by the document transport device 52, or a reading document G placed on the platen glass 54.

The document transport device 52 includes an automatic transport path 55 in which pairs of transport rollers 53 are disposed. A portion of the automatic transport path 55 is disposed so that a piece of recording paper R passes above the platen glass 54. The document reading device 56 reads a reading document G transported by the document transport device 52 while being stationary at a left end portion of the platen glass 54, and reads a reading document G placed on the platen glass 54 while moving in the direction of arrow H.

The image forming section 14 includes an image forming unit 50 serving as an exemplary developer image forming unit that forms a toner image (developer image) on a piece of recording paper P. The image forming unit 50 includes a photoconductor member 62, a charging member 64, an exposure device 66, a developing device 70, an intermediate transfer belt 68, and a cleaning device 73, which are described below.

The cylindrical photoconductor member 62 serving as an exemplary latent image holding member is provided at the center of the apparatus body 10A in the image forming section 14. The photoconductor member 62 is rotated in the direction of arrow +R (counterclockwise in FIG. 1) by a driving unit (not shown), and holds an electrostatic latent image formed by light irradiation. The corotron charging member 64 that charges the surface of the photoconductor member 62 is provided at a location that is situated above the photoconductor member 62 and that opposes an outer peripheral surface of the photoconductor member 62.

The exposure device 66 is provided at a location that is situated downstream from the charging member 64 in a direction of rotation of the photoconductor member 62 and that opposes the outer peripheral surface of the photoconductor member 62. The exposure device 66 includes a semiconductor laser, a f-θ lens, a polygonal mirror, an imaging lens, and mirrors (none of which are shown). On the basis of an image signal, laser light emitted from the semiconductor laser is used to perform scanning by being deflected by the polygonal mirror, and illuminates (exposes) the outer peripheral surface of the photoconductor member 62 charged by the charging member 64, to form an electrostatic latent image. The exposure device 66 may be a light emitting diode (LED) type instead of a type in which laser light is used to perform scanning by being deflected by the polygonal mirror.

The developing device 70 of a rotation switching type is provided downstream from a portion of the photoconductor member 62 that is irradiated with exposure light from the exposure device 66 in the direction of rotation of the photoconductor member 62. The developing device 70 develops the electrostatic latent image formed on the outer peripheral surface of the photoconductor member 62 with toner of a set color to make the electrostatic latent image visible.

Figure 2:
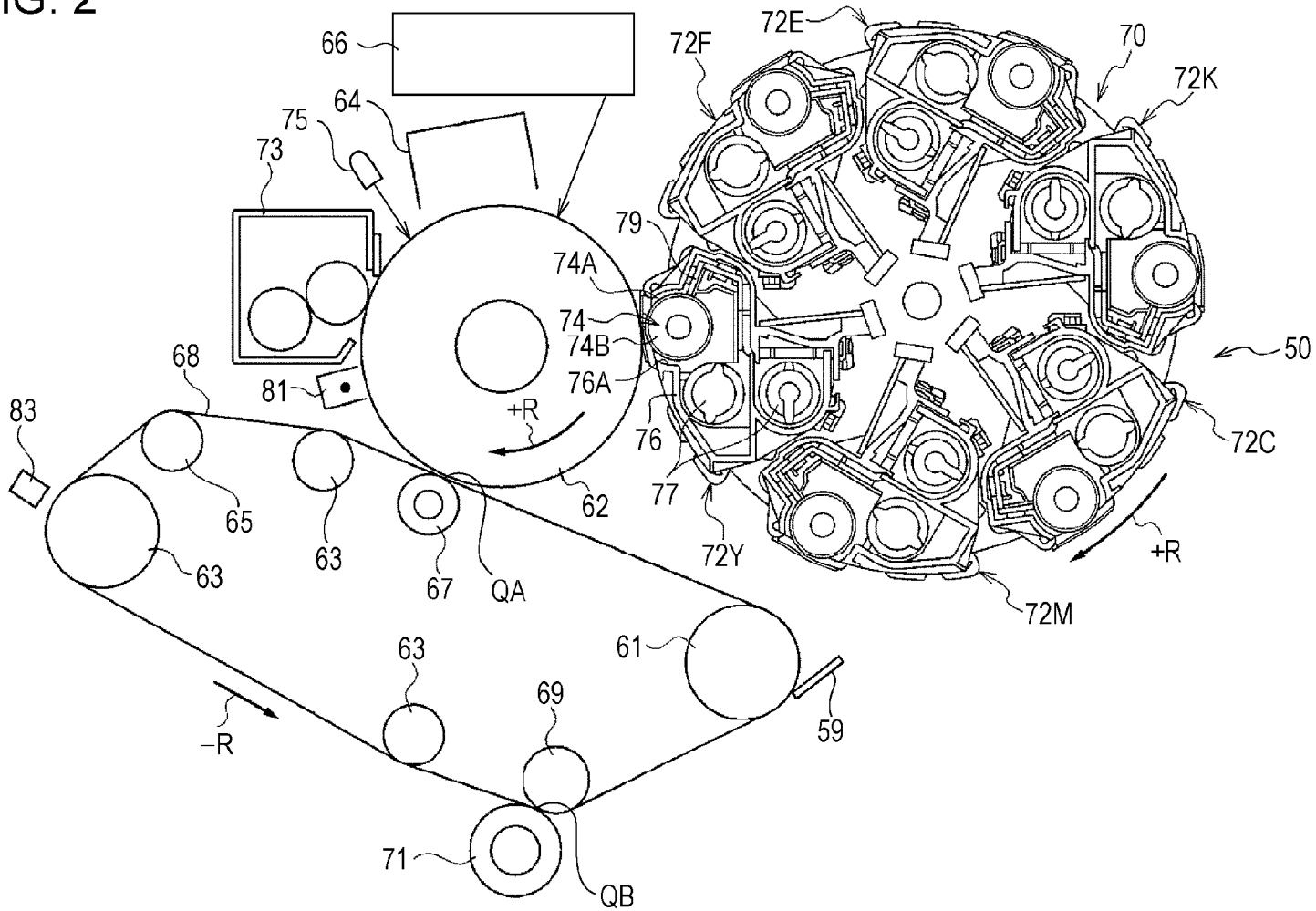
FIG. 2 shows a structure of an image forming section according to the exemplary embodiment of the present invention.

As shown in FIG. 2, in the developing device 70, developing units 72Y, 72M, 72C, 72K, 72E, and 72F corresponding to toner colors, yellow (Y), magenta (M), cyan (C), black (K), a first special color (E), and a second special color (F), are disposed side by side in a peripheral direction (that is, in this order in a counterclockwise direction in FIG. 2). By rotating the developing units by central angles of 60 degrees at a time by a motor (not shown), the developing unit 72Y, 72M, 72C, 72K, 72E, or 72F is switched to that which performs a developing operation, and opposes the outer peripheral surface of the photoconductor member 62.

Since the developing units 72Y, 72M, 72C, 72K, 72E, and 72F have the same structure, the developing unit 72Y will be described here, and the other developing units 72M, 72C, 72K, 72E, and 72F will not be described. Since the developing units 72E and 72F are not used when images are formed using four colors, Y, M, C, and K, the rotational angle from the developing unit 72K to the developing unit 72Y is 180 degrees.

The developing unit 72Y includes a case member 76 serving as a body. The interior of the case member 76 is filled with a developer (not shown) containing toner and carriers supplied from a toner cartridge 78Y (see FIG. 1) through a toner supply path (not shown). A rectangular opening 76A that opposes the outer peripheral surface of the photoconductor member 62 is formed in the case member 76. A development roller 74 whose outer peripheral surface opposes the outer peripheral surface of the photoconductor member 62 is provided at the opening 76A. A plate-like regulating member 79 that regulates the thickness of a layer of a developer is provided near the opening 76A in the case member 76 along a longitudinal direction of the opening 76A.

The development roller 74 includes a rotatable cylindrical development sleeve 74A and a magnetic member 74B including magnetic poles and secured to the inner side of the development sleeve 74A. By rotating the development sleeve 74A, a magnetic brush of a developer (carrier) is formed. In addition, by regulating the thickness of the layer of the developer by the regulating member 79, the developer layer is formed on an outer peripheral surface of the development sleeve 74A. The developer layer on the outer peripheral surface of the development sleeve 74A is transported to a location opposing the photoconductor member 62 by rotating the development sleeve 74A, so that toner corresponding to the latent image (electrostatic latent image) formed on the outer peripheral surface of the photoconductor member 62 is caused to adhere to the latent image, thereby developing the latent image.

Two rotatable spiral transport rollers 77 are disposed side by side in the case member 76. By rotating the two transport rollers 77, the developer with which the interior of the case member 76 is filled is circulated and transported in an axial direction of the development roller (that is, in a longitudinal direction of the developing unit 72Y). Six development rollers 74 provided at the corresponding developing units 72Y, 72M, 72C, 72K, 72E, and 72F are disposed in the peripheral direction so that development rollers 74 that are adjacent to each other are spaced apart by a central angle of 60 degrees. By switching a certain developing unit 72, a next development roller 74 is caused to oppose the outer peripheral surface of the photoconductor member 62.

As shown in FIG. 1, the intermediate transfer belt 68 serving as an exemplary transfer member to which a toner image formed on the outer peripheral surface of the photoconductor member 62 is transferred is provided downstream from the developing device 70 in the direction of rotation of the photoconductor member 62 and below the photoconductor member 62. The intermediate transfer belt 68 is an endless belt, and is wound on a driving roller 61, a tension applying roller 65, transport rollers 63, and an auxiliary roller 69. The driving roller 61 is rotationally driven by the controller 20. The tension applying roller 65 applies tension to the intermediate transfer belt 68. The transport rollers 63 contact an inner side of the intermediate transfer belt 68, and are driven and rotated. The auxiliary roller 69 contacts the inner side of the intermediate transfer belt 68 and is driven and rotated at the second transfer position QB (described later; see FIG. 2). When the driving roller 61 rotates, the intermediate transfer belt 68 rotates in the direction of arrow −R (that is, counterclockwise in FIG. 1).

A first transfer roller 67 serving as an exemplary first transfer unit that first-transfers a toner image formed on the outer peripheral surface of the photoconductor member 62 to the intermediate transfer belt 68 is provided opposite the photoconductor member 62 with the intermediate transfer belt 68 being interposed therebetween. The first transfer roller 67 contacts the inner surface of the intermediate transfer belt 68 at a location that is spaced apart and downstream in the direction of movement of the intermediate transfer belt 68 from a position where the photoconductor member 62 and the intermediate transfer belt 68 contact each other (this position is called a first transfer position QA (see FIG. 2)). By applying current from a power supply (not shown), the first transfer roller 67 first-transfers the toner image on the photoconductor member 62 to the intermediate transfer belt 68 due to a potential difference between the first transfer roller 67 and the photoconductor member 62 connected to ground.

A second transfer roller 71 serving as an exemplary second transfer unit that second-transfers the toner image first-transferred to the intermediate transfer belt 68 to a piece of recording paper P is provided opposite the auxiliary roller 69 with the intermediate transfer belt 68 being interposed therebetween. A position between the second transfer roller 71 and the auxiliary roller 69 is the second transfer position QB (see FIG. 2) where the toner image is transferred to the piece of recording paper P. The second transfer roller 71 is connected to ground and contacts an outer surface of the intermediate transfer belt 68. By a potential difference between the second transfer roller 71 and the auxiliary roller 69 to which current is applied from a power supply (not shown), the second transfer roller 71 causes the toner image on the intermediate transfer belt 68 to be second-transferred to the piece of recording paper P.

A cleaning blade 59 that collects residual toner remaining after the second transfer on the intermediate transfer belt 68 is provided opposite the driving roller 61 with the intermediate transfer belt 68 being interposed therebetween. The cleaning blade 59 is mounted to a housing (not shown) having an opening. The toner scraped off by an end portion of the cleaning blade 59 is collected in the housing.

A position detecting sensor 83 is provided at a position opposing one of the transport rollers 63 in the vicinity of the intermediate transfer belt 68. The position detecting sensor 83 detects a mark (not shown) on the surface of the intermediate transfer belt 68 to detect a predetermined reference position on the intermediate transfer belt 68, and outputs a position detection signal serving as a reference of a timing of starting an image forming operation. The position detecting sensor 83 illuminates the intermediate transfer belt 68 with light, and receives the light reflected from the surface of the mark, to detect the position of movement of the intermediate transfer belt 68.

A cleaning device 73 that cleans off, for example, residual toner remaining on the surface of the photoconductor member 62 without being first-transferred to the intermediate transfer belt 68 is provided downstream from the first transfer roller 67 in the direction of rotation of the photoconductor member 62. The cleaning device 73 is formed so that, for example, residual toner is collected by a cleaning blade 73A and a brush roller 73B that contact the surface of the photoconductor member 62.

A corotron 81 that removes electricity from the toner remaining after the first transfer on the outer peripheral surface of the photoconductor member 62 is provided upstream from the cleaning device 73 (that is, downstream from the first transfer roller 67) in the direction of rotation of the photoconductor member 62. Further, an electricity removing device 75 that removes electricity by irradiating the outer peripheral surface of the photoconductor member 62 with light after the cleaning is provided downstream from the cleaning device 73 (that is, upstream from the charging member 64) in the direction of rotation of the photoconductor member 62.

The second transfer position QB where the toner image is second-transferred by the second transfer roller 71 is set in the aforementioned transport path 28. A fixing device 100 that fixes the toner image to a piece of recording paper P to which the toner image has been transferred by the second transfer roller 71 is provided downstream from the second transfer roller 71 in the direction of transport of the recording paper P (that is, in the direction of arrow A in FIG. 1) at the transport path 28. The fixing device 100 will be described in more detail later.

Transport rollers 39 that transport the piece of recording paper P towards the discharge section 15 or the reversing section 33 are provided downstream from the fixing device 100 in the direction of transport of the recording paper P at the transport path 28. The toner cartridge 78Y and toner cartridges 78M, 78C, 78K, 78E, and 78F that contain toners of corresponding colors, yellow (Y), magenta (M), cyan (C), black (K), the first special color (E), and the second special color (F), are replaceably provided side by side in the direction of arrow H and above the developing device 70 that is situated below the document reading device 56. The first special color E and the second special color F are selected from special colors (including transparent colors) other than yellow, magenta, cyan, and black, or are not selected therefrom.

Fixing Device

Next, the fixing device 100 will be described.

Figure 3:
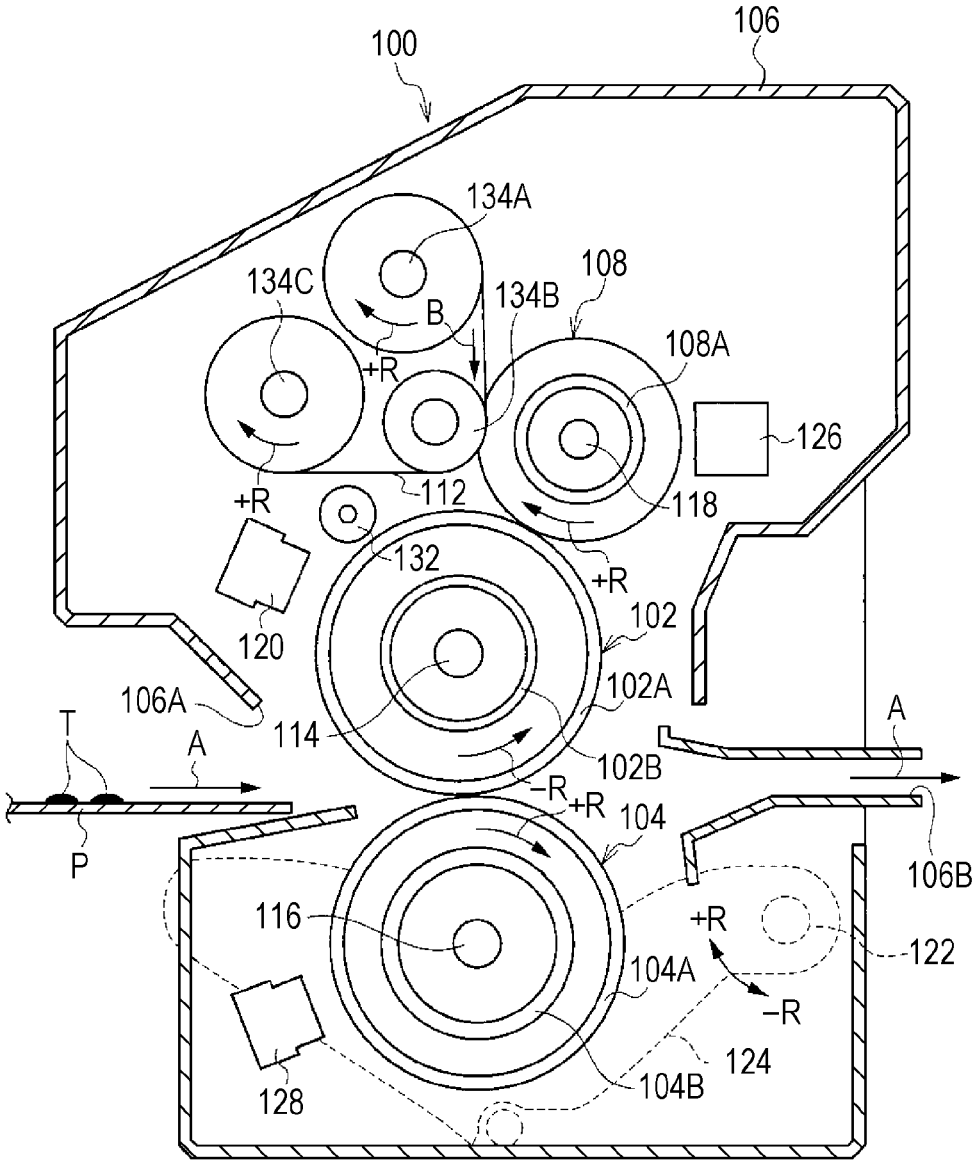
FIG. 3 shows a structure of a fixing device according to the exemplary embodiment of the present invention.

As shown in FIG. 3, the fixing device 100 includes a housing 106 having an opening 106A and an opening 106B. A piece of recording paper P enters the opening 106A. The piece of paper P is discharged from the opening 106B. A fixing roller 102, a pressure roller 104, an external heating roller 108, and a web 112 are provided as principal portions in the housing 106. The fixing roller 102 serves as an exemplary fixing member that fixes a toner image by heating. The pressure roller 104 presses the recording paper P towards the fixing roller 102. The external heating roller 108 serving as an exemplary external heating member and contact member heats the fixing roller 102. The web 112 serving as a exemplary oil supplying unit contacts the outer peripheral surface of the external heating roller 108, and supplies oil (lubricant) to the external heating roller 108.

The fixing roller 102 is disposed at a toner image surface side (upper side) of the recording paper P at the transport path. In an example of the fixing roller 102, an outer periphery of an aluminum cylindrical core bar 102B is covered by an elastic member 102A formed of silicone rubber, and a releasing layer (not shown) formed of fluorocarbon resin is formed along an outer peripheral surface of the elastic member 102A. A halogen heater 114 is provided inwardly of the core bar 102B. The halogen heater 114 serves as a heat source that is out of contact with an inner peripheral surface of the core bar 102B. The halogen heater 114 generates heat by application of current of a power supply (not shown), and heats the core bar 102B, so that the entire fixing roller 102 is heated.

A first temperature sensor 120 that detects the temperature of the fixing roller 102 and a refresh roller 132 that smoothens an outer peripheral surface of the fixing roller 102 are provided so as to oppose the outer peripheral surface of the fixing roller 102. The first temperature sensor 120 is a noncontact temperature sensor. An infrared film of the first temperature sensor 120 receives heat radiation from the fixing roller 102, and a rise in temperature of the infrared film is detected by a thermistor, so that the temperature of the fixing roller 102 is detected. The refresh roller 132 is separated from the outer peripheral surface of the fixing roller 102. When the number of sheets to which toner images are fixed has reached a preset number of sheets, the refresh roller 132 moves so as to contact and smoothen the outer peripheral surface of the fixing roller 102.

For example, the external heating roller 108 is an aluminum cylindrical roller, and includes a cylindrical shaft section 108A at each end portion in a longitudinal direction thereof. A halogen heater 118 is provided at an inner side of the external heating roller 108. The halogen heater 118 serves as a heat source that is out of contact with an inner peripheral surface of the external heating roller 108. The halogen heater 118 generates heat by application of current of a power supply (not shown), so that the entire external heating roller 108 is heated.

The external heating roller 108 is provided so as oppose the outer peripheral surface of the fixing roller 102. The external heating roller 108 is formed so that a retracting mechanical section 140 (see FIG. 4) serving as an exemplary moving unit (described later) causes the external heating roller 108 to move between a contact position (see FIGS. 8A and 9B) and a separation position (see FIGS. 8B and 9A). The contact position is where the external heating roller 108 contacts the outer peripheral surface of the fixing roller 102. The separation position is where the external heating roller 108 is separated from the outer peripheral surface of the fixing roller 102.

A contact second temperature sensor 126 that detects the temperature of the external heating roller 108 is provided so as to oppose the outer peripheral surface of the external heating roller 108. For example, the external heating roller 108 is heated to a temperature that is higher than the temperature of the fixing roller 102 by approximately 50° C. to 70° C.

The web 112 is a fiber member for cleaning the outer peripheral surface of the external heating roller 108. The web 112 is previously impregnated with oil serving as a lubricant for reducing friction force generated when the web 112 contacts the external heating roller 108, and is wound around a shaft section 134A provided so as to be rotatable in the direction of arrow +R. An intermediate roller 134B is rotatably disposed below the shaft section 134A. A shaft section 134C that is rotatable in the direction of arrow +R is disposed on the left of the intermediate roller 134B so as to be spaced therefrom.

Here, the web 112 is wound around an outer peripheral surface of the intermediate roller 134B by being wound from the shaft section 134A, and is wound on the shaft section 134C by securing an end of the web 112 to the shaft section 134C. When the shaft section 134C is rotationally driven in the direction of arrow +R by a motor (not shown), the web 112 moves in the direction of arrow B, so that the web 112 comes into contact with the outer peripheral surface of the external heating roller 108, and is wound up by the shaft section 134C.

The web 112 is wound up as required when the fixing device 100 performs a fixing operation, and is constantly in contact with the external heating roller 108. The fixing operation refers to an operation from when the fixing roller 102 starts to rotate to when the fixing of a toner image to a piece of recording paper P ends and the fixing roller 102 stops rotating. The fixing operation also includes a state in which the recording paper P has not entered a contact portion (nip) between the fixing roller 102 and the pressure roller 104.

The pressure roller 104 is disposed below the fixing roller 102 at the transport path of the recording paper P. In an example of the pressure roller 104, an outer periphery of an aluminum cylindrical core bar 104B is covered by an elastic member 104A formed of silicone rubber, and a releasing layer (not shown) formed of fluorocarbon resin is formed along an outer peripheral surface of the elastic member 104A. A halogen heater 116 is provided inwardly of the core bar 104B. The halogen heater 116 serves as a heat source that is out of contact with an inner peripheral surface of the core bar 104B. The halogen heater 116 generates heat by application of current of a power supply (not shown), and heats the core bar 104B, so that the entire pressure roller 104 is heated.

A third temperature sensor 128 that detects the temperature of the pressure roller 104 is provided so as to oppose the outer peripheral surface of the pressure roller 104, and so as to be out of contact with the pressure roller 104. The third temperature sensor 128 has the same structure as the first temperature sensor 120. Here, the first temperature sensor 120, the second temperature sensor 126, and the third temperature sensor 128 are connected to the controller 20 (see FIG. 1). On the basis of inputs from the first temperature sensor 120, the second temperature sensor 126, and the third temperature sensor 128, the controller 20 performs output operations to the halogen heaters 114, 118, and 116.

Further, bearings (not shown) are provided at corresponding end portions of the pressure roller 104. The bearings are mounted to a central portion of a V-shaped bracket 124. The bracket 124 is provided so as to be rotatable in the direction of arrow +R or the direction of arrow −R around a shaft section 122, mounted to the housing 106, by an operation of an eccentric cam (not shown). By this, when the bracket 124 moves in the direction of arrow +R, the pressure roller 104 contacts the fixing roller 102, whereas, when the bracket 124 moves in the direction of arrow −R, the pressure roller 104 separates from the fixing roller 102.

Retracting Mechanical Section

Next, the retracting mechanical section 140 of the external heating roller 108 is described.

Figure 4:
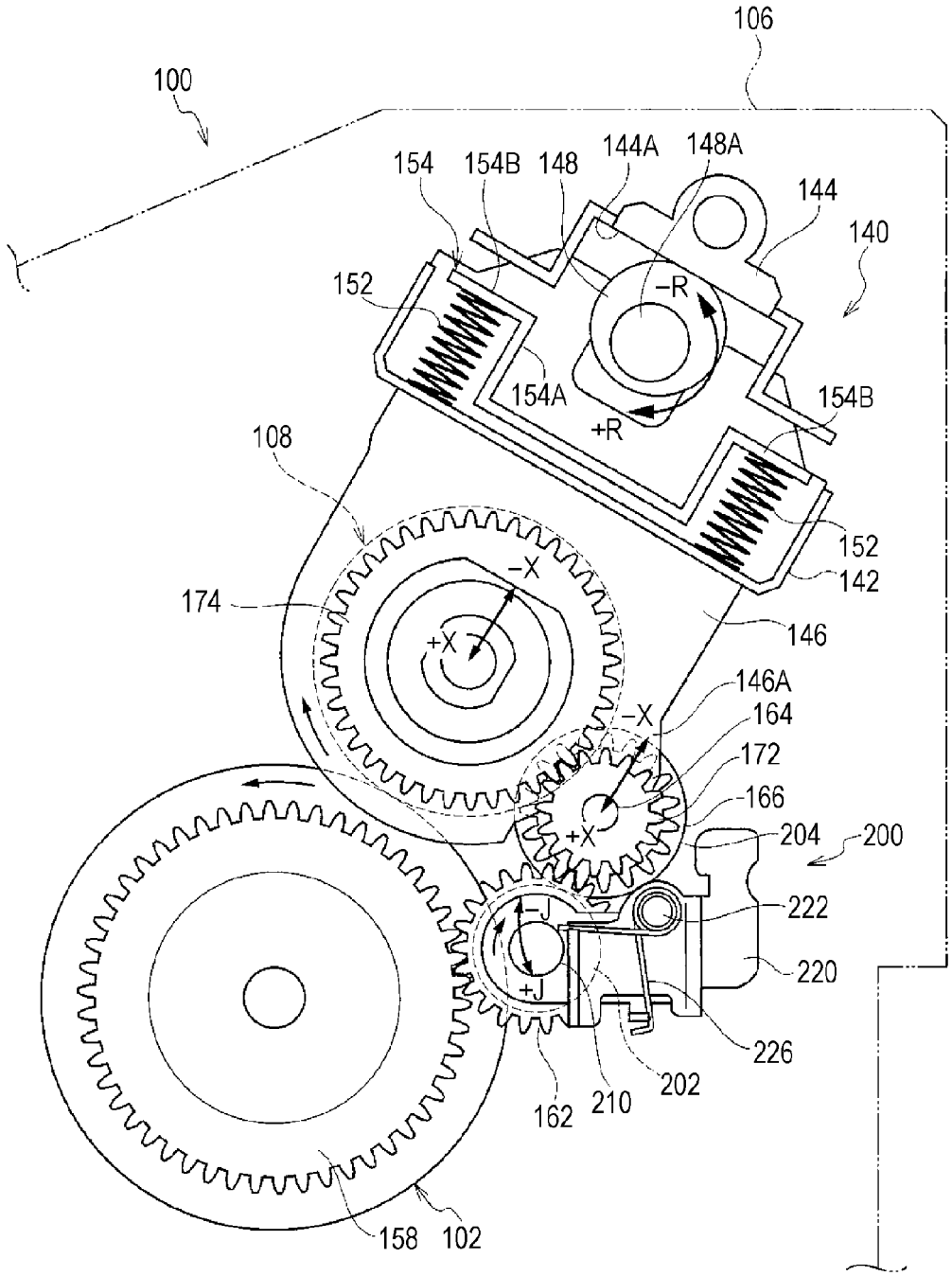
FIG. 4 is a front view of a retracting mechanism of an external heating roller of the fixing device according to the exemplary embodiment of the present invention.
Figure 5:
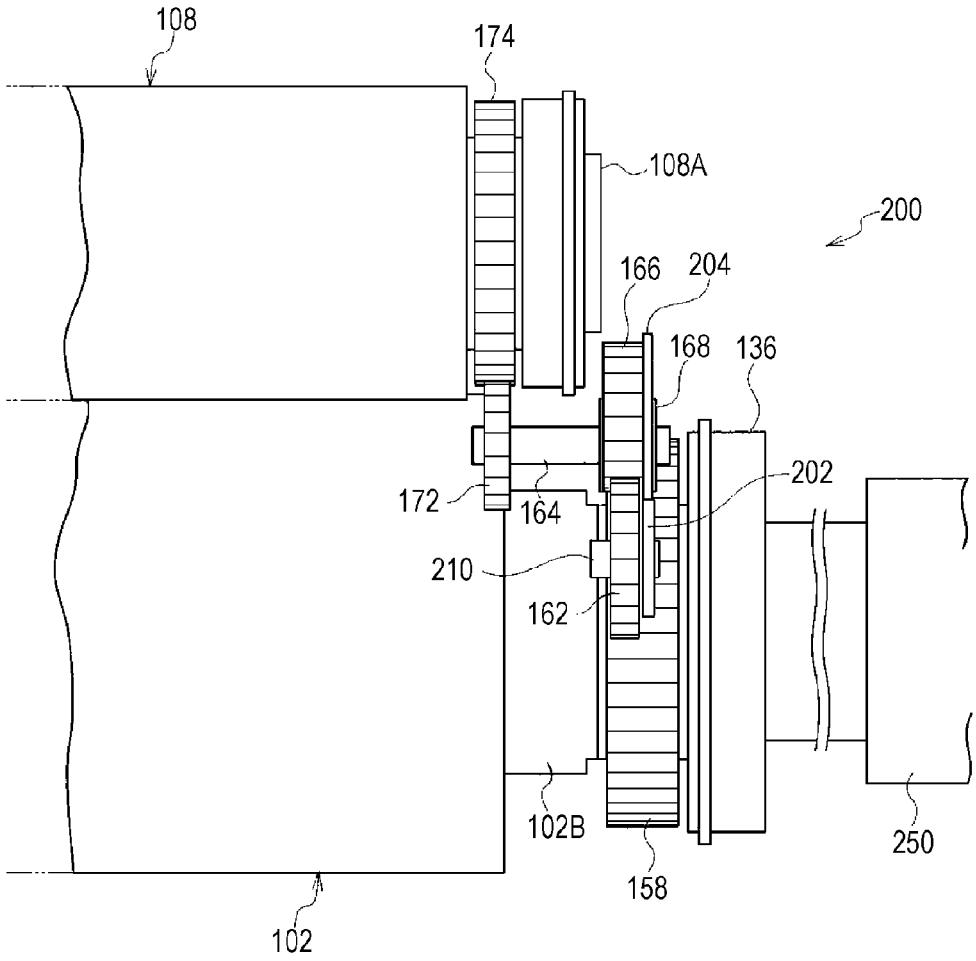
FIG. 5 is a plan view showing a state of engagement of each gear in a drive transmitting mechanism of the fixing device according to the exemplary embodiment of the present invention.
Figure 6:
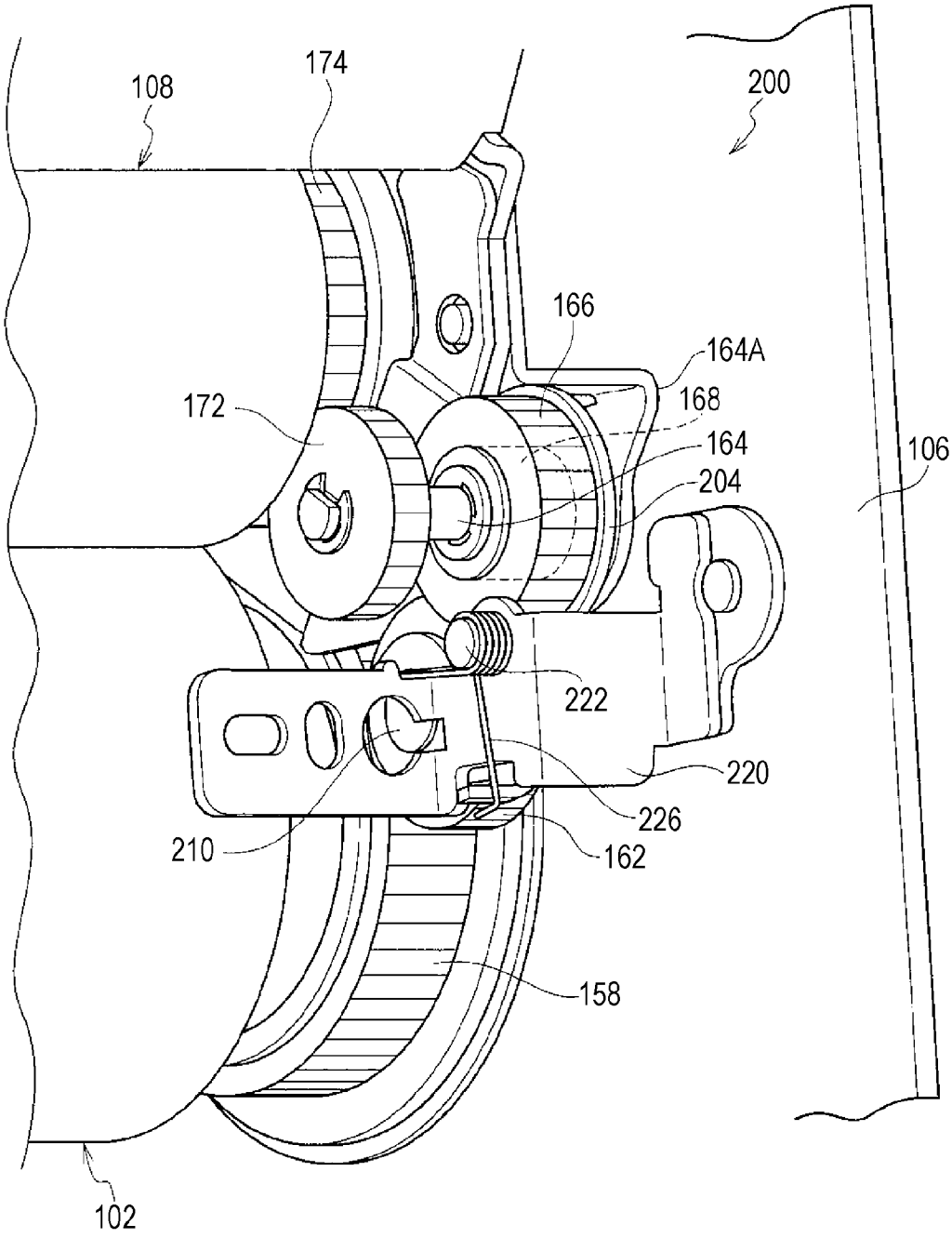
FIG. 6 is a perspective view of the drive transmitting mechanism of the fixing device according to the exemplary embodiment of the present invention as seen from an inner side of the fixing device.
Figure 7:
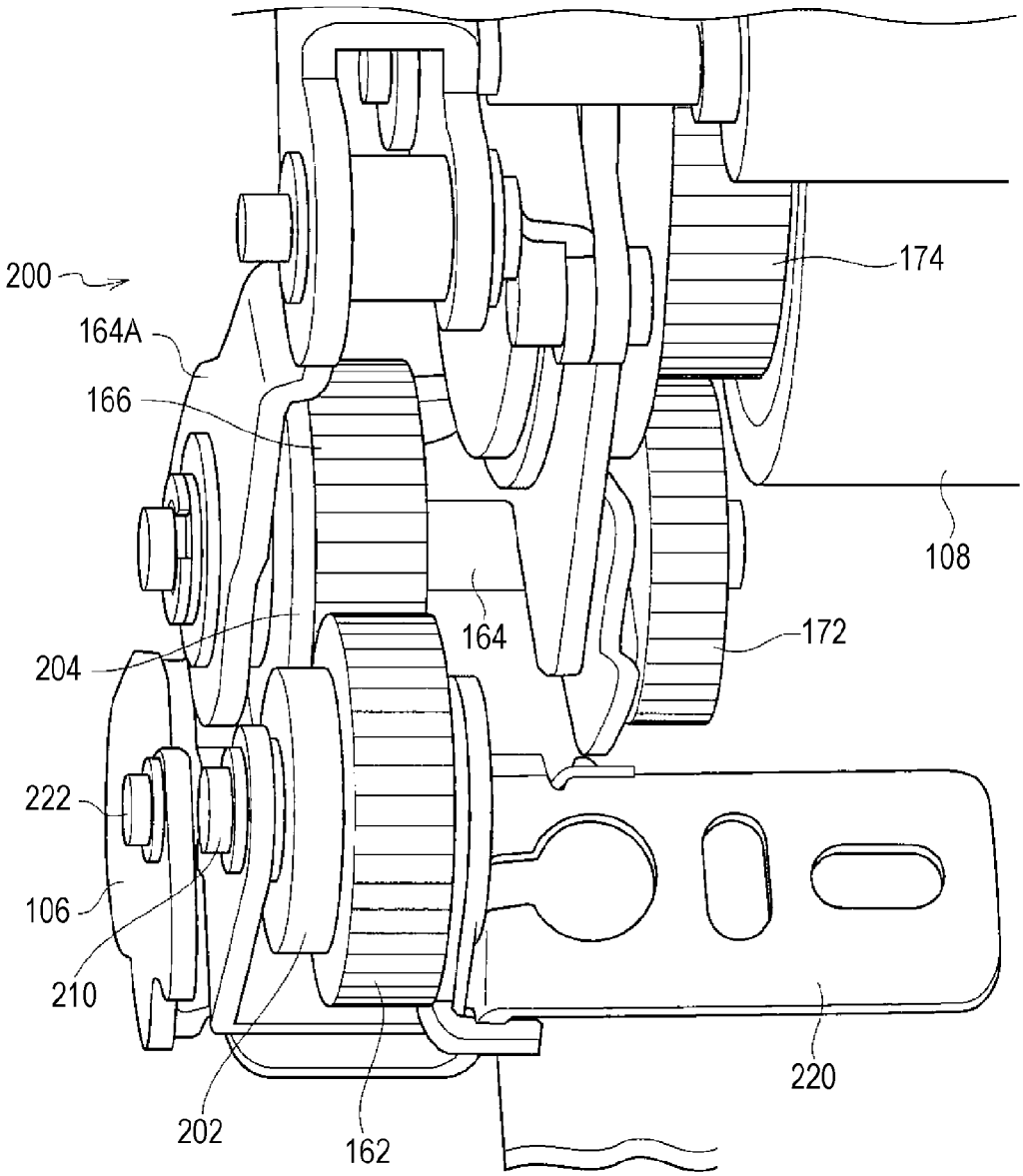
FIG. 7 is a perspective view of the drive transmitting mechanism of the fixing device according to the exemplary embodiment of the present invention as seen from an outer side of the fixing device.

As shown in FIG. 4, the retracting mechanical section 140 includes brackets 142 and 144, a bracket 146, an eccentric cam 148, and a spring 152. The brackets 142 and 144 are mounted to the housing 106. The bracket 146 rotatably supports the external heating roller 108. The eccentric cam 148 is provided at the bracket 146. The spring 152 biases the bracket 146.

In the description below, the direction in which the external heating roller 108 moves closer to the fixing roller 102 is defined as a +X direction, and the direction in which the external heating roller 108 moves away from the fixing roller 102 is defined as a −X direction. The +X direction and the −X direction are defined on the basis of a line that is inclined rightwards in FIG. 4.

The brackets 142 and 144 are provided so that the bracket 142 is provided at a near side of the external heating roller 108 (in the +X direction), and the bracket 144 is provided at a far side of the external heating roller 108 (in the −X direction) such that the brackets 142 and 144 oppose each other at a side opposite the fixing roller 102 with the external heating roller 108 being disposed between the fixing roller 102 and the brackets 142 and 144. The bracket 142 has a C shape in cross section, and is mounted to the housing 106 so as to open at a side thereof facing the bracket 144. The bracket 144 has a recessed portion 144A at a center thereof. The recessed portion 144A is mounted to the housing 106 so as to oppose the bracket 142.

The external heating roller 108 is rotatably supported by the bracket 146. Although a pair of brackets 146 are provided, one at each end of the external heating roller 108, only one of the brackets 146 will be shown here. The movement of the bracket 146 is restricted to only the +X direction and the −X direction by a guide member (not shown).

The bracket 146 is provided with an inverted-hat-shaped flange 154 protruding from the bracket 146 in an axial direction of the external heating roller 108. As viewed from the axial direction of the external heating roller 108, a recessed portion 154A having a C shape in cross section is formed in the center of the flange 154, and a flat portion 154B is formed outwardly from a peripheral edge of the recessed portion 154A. The flange 154 is disposed between the bracket 142 and the bracket 144 so that an open side of the recessed portion 154A opposes the recessed portion 144A of the bracket 144 and so that the flat portion 154B opposes the bracket 142. A projecting portion 146A is formed at the bracket 146, and rotatably supports a shaft 164 where intermediate gears 166 and 172 (described later) are provided.

The eccentric cam 148 has a rotary shaft 148A, and is caused to be rotatable in the direction of arrow +R or the direction of arrow −R by inserting the rotary shaft 148A into a bearing (not shown) secured to an end portion of the bracket 146 in the −X direction. The eccentric cam 148 is rotatably driven in the direction of arrow +R or in the direction of arrow −R by a motor (not shown). When the eccentric cam 148 is rotated in the direction of arrow −R, an outer peripheral portion of the eccentric cam 148 comes into contact with the recessed portion 144A of the bracket 144, whereas, when the eccentric cam 148 is rotated in the direction of arrow +R, the outer peripheral portion of the eccentric cam 148 separates from the recessed portion 144A.

One end of the spring 152 is secured to the bracket 142 so as to be interposed between the flat portion 154B of the flange 154 and the bracket 142. When the bracket 146 moves in the +X direction, the spring 152 biases the bracket 146 in the −X direction.

Accordingly, in the retracting mechanical section 140, when the eccentric cam 148 rotates in the direction of arrow −R and comes into contact with the bracket 144, the bracket 146 moves in the direction of arrow +X, so that the external heating roller 108 is positioned at the contact position (see FIGS. 8A and 9B) where the external heating roller 108 contacts the outer peripheral surface of the fixing roller 102. When the eccentric cam 148 rotates in the direction of arrow +R and separates from the bracket 144, biasing force of the spring 152 causes the bracket 146 to move in the direction of arrow −X, so that the external heating roller 108 is positioned at the separation position (see FIGS. 8B and 9A) where the external heating roller 108 is separated from the outer peripheral surface of the fixing roller 102. That is, the retracting mechanical section 140 is switched between a state in which the external heating roller 108 contacts the fixing roller 102, and a state in which the external heating roller 108 does not contact the fixing roller 102. The retracting mechanical section 140 is controlled by the controller 120 (see FIG. 1). The controller 20 causes the external heating roller 108 to move from the separation position (see FIGS. 8B and 9A) to the contact position (see FIGS. 8A and 9B) after the fixing roller 102 starts a fixing operation.

Drive Transmitting Mechanism

Next, a drive transmitting mechanism 200 that transmits driving force that rotates the fixing roller 102 and the external heating roller 108 will be described with reference to FIGS. 4 to 7.

As shown in FIGS. 4 to 7, a fixing-roller-side gear 158 is provided at an end portion of the core bar 102B of the fixing roller 102 so as to integrally rotate. The fixing-roller-side gear 158 is rotationally driven by a driving device 250 (see FIG. 5) including, for example, a motor.

An intermediate gear 162 engages the fixing-roller-side gear 158. The intermediate gear 162 is provided at a shaft 210 that is rotatably supported at an arm member 220 (described below). An intermediate gear 166 engages the intermediate gear 162. The intermediate gear 166 is provided at a shaft 164 that is rotatably supported at the projecting portion 146A (see FIG. 4) of the bracket 146. Further, an intermediate gear 172 is provided at the shaft 164.

An external-heating-roller-side gear 174 is provided at one end (at the same side as where the fixing-roller-side gear 158 is provided) of the shaft section 108A (see FIG. 4) of the external heating roller 108 so as to integrally rotate. The intermediate gear 172 engages the external-heating-roller-side gear 174.

As mentioned above, the shaft 164 is provided at the projecting portion 146A of the bracket 146 that supports the external heating roller 108. Therefore, the movement of the external heating roller 108 causes the intermediate gears 166 and 172, provided at the shaft 164, and the external-heating-roller-side gear 174 to move in an X direction together with the external heating roller 108.

The shaft 210 for the intermediate gear 162 that engages the fixing-roller-side gear 158 is supported by the arm member 220 that rotates around a rotary shaft 222 as a center of rotation at the housing 106. Therefore, the intermediate gear 162 rotates in the direction of arrow +J and in the direction of arrow −J (see FIG. 4). The arm member 220 is biased in the direction of arrow −J by a spring 226 serving as an exemplary biasing unit.

A tracking roller 202 is provided at an outer side of the intermediate gear 162. A tracking roller 204 is provided at an outer side of the intermediate gear 166. When the tracking roller 202 and the tracking roller 204 contact each other, an axial distance L2 (see FIGS. 9A and 9B) between the intermediate gears 162 and 166 is maintained.

Figure 9A:
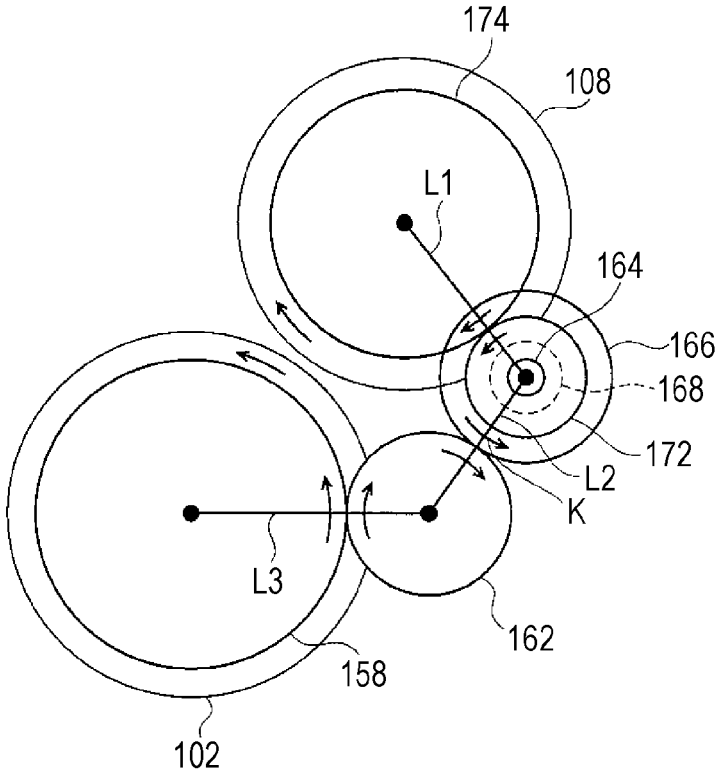
FIG. 9A is a schematic view of each gear shown in FIG. 8B.
Figure 9B:
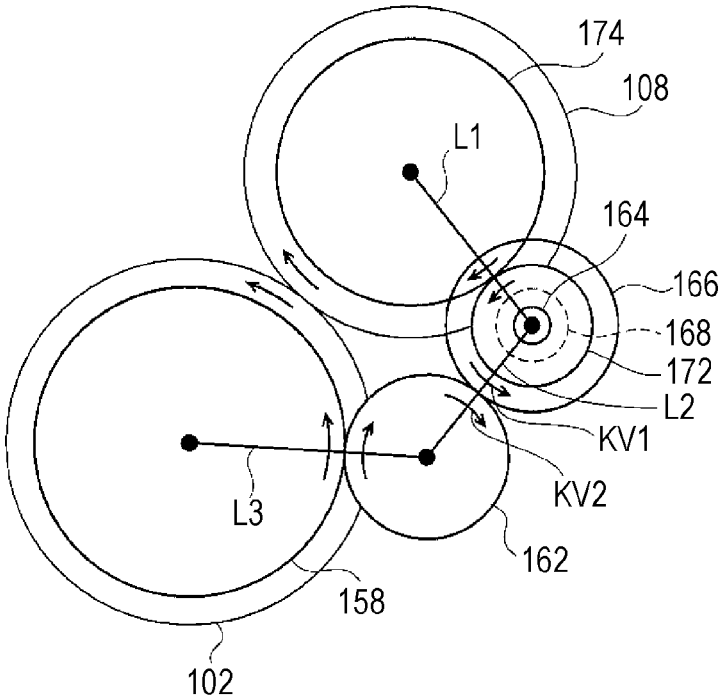
FIG. 9B is a schematic view of each gear shown in FIG. 8A.

The fixing roller 102, the external heating roller 108, and each gear rotate in the directions of the corresponding arrows shown in FIGS. 9A and 9B. A one-way clutch 168 is built in the intermediate gear 166. When the intermediate gear 166 rotates in the direction of rotation of arrow K shown in FIG. 9A, the one-way clutch 168 causes driving force to be transmitted between the intermediate gear 166 and the shaft 164 (intermediate gear 172). When the intermediate gear 166 rotates in a direction of rotation that is opposite to the direction of rotation of arrow K, the one-way clutch 168 rotates idly, so that driving force is not transmitted between the intermediate gear 166 and the shaft 164.

Operations and Advantages

Next, the operations and advantages of the exemplary embodiments will be described.

Figure 8B:
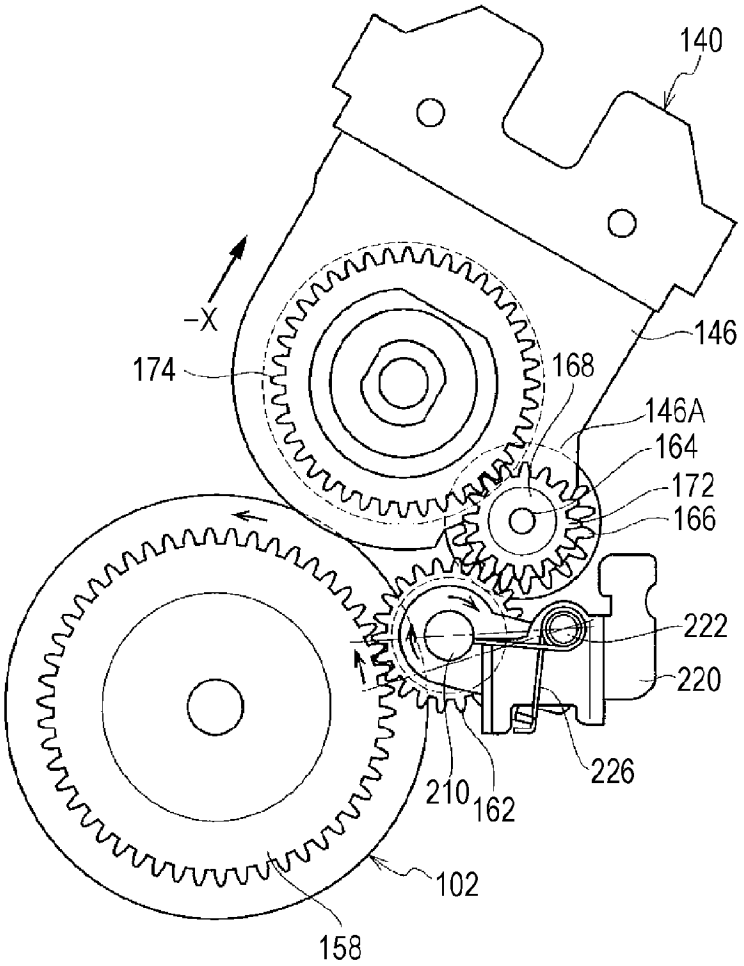
FIG. 8B is a front view showing a state in which the external heating roller is separated from the fixing roller.

As shown in FIG. 8B and FIG. 9A, when the external heating roller 108 is at the separation position where it is separated from the fixing roller 102, driving force of the fixing roller 102 is transmitted to the external heating roller 108 through the fixing-roller-side gear 158, the intermediate gear 166, the intermediate gear 172, and the external-heating-roller-side gear 174, so that the external heating roller 108 rotates. At this time, the one-way clutch 168 causes driving force to be transmitted between the intermediate gear 166 and the shaft 164.

Figure 8A:
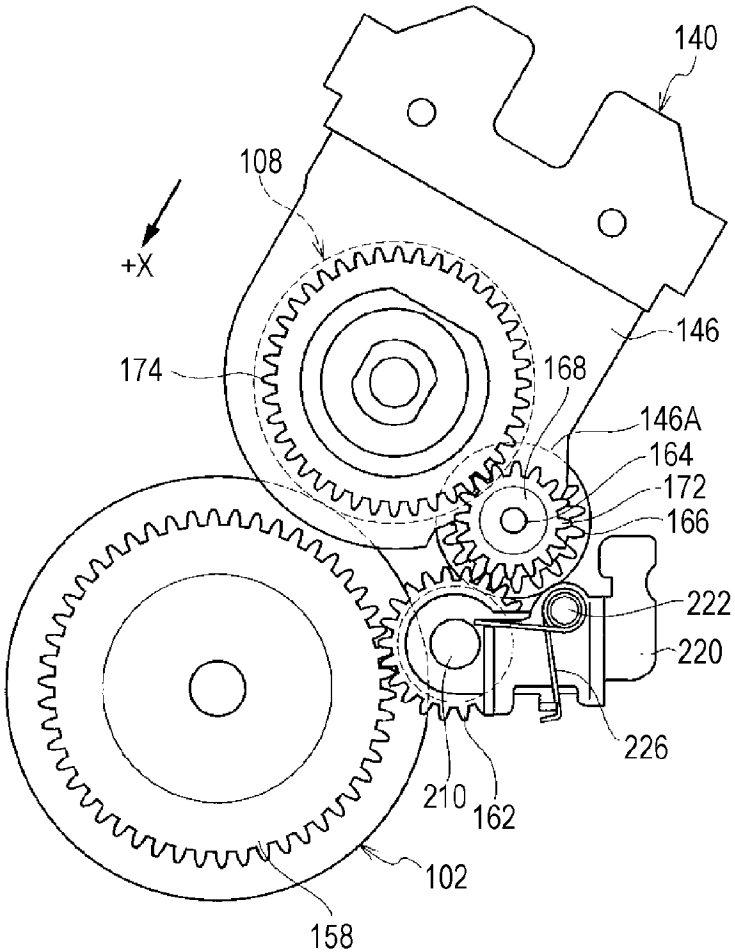
FIG. 8A is a front view showing a state in which the external heating roller of the fixing device according to the exemplary embodiment of the present invention contacts a fixing roller.

As shown in FIGS. 8A and 9B, when the external heating roller 108 is at the contact position where it contacts the fixing roller 102, the external heating roller 108 is driven and rotated by the fixing roller 102.

The numbers of teeth of the intermediate gears 162 and 166 are set so that the number of rotations KV1 (see FIG. 9B) of the intermediate gear 166 in this state is greater than the number of rotations KV2 (see FIG. 9B) of the intermediate gear 162 in this state (that is, the number of rotations KV1 (rpm)>the number of rotations KV2 (rpm)). (In other words, the number of teeth of the intermediate gear 166 is less than that of the intermediate gear 162 so that the number of rotations of the intermediate gear 166 is greater than the number of rotations of the intermediate gear 162. The number of rotations (rpm) refers to the speed of rotation per unit time, and is also called rotational speed.

By setting the numbers of teeth in this way, the rotational speed of the intermediate gear 166 becomes less than the rotational speed of the shaft 164. Therefore, the state becomes the same as that when the intermediate gear 166 rotates relatively in a direction opposite to the direction of arrow K. The one-way clutch 168 that is built in the intermediate gear 166 rotates idly without transmitting driving force to the shaft 164. In other words, the one-way clutch 168 does not transmit driving force between the intermediate gear 166 and the shaft 164. Therefore, driving force is not transmitted from the fixing roller 102 to the shaft 164. Consequently, it is possible for the external heating roller 108 to be driven and rotated by the fixing roller 102.

Since the one-way clutch 168 built in the intermediate gear 166 rotates idly without transmitting driving force from the shaft 164 to the intermediate gear 166, the rotational speed of the intermediate gear 166 is actually the same as the rotational speed of the intermediate gear 162. As mentioned above, the rotational speed of the intermediate gear 166 is less than the rotational speed of the shaft 16. Therefore, the state becomes the same as that when the intermediate gear 166 rotates relatively in a direction opposite to the direction of arrow K, so that the one-way clutch 168 rotates idly.

The shaft 164 is supported by the projecting portion 146A of the bracket 146 supporting the external heating roller 108. Therefore, the intermediate gears 166 and 172, provided at the shaft 164, the external-heating-roller-side gear 174, and the external heating roller 108 move together in the X direction. Consequently, even if the external heating roller 108 moves in the direction X, an axial distance L1 (see FIGS. 9A and 9B) between the external-heating-roller-side gear 174 and the intermediate gear 172 does not change.

When the external heating roller 108 moves in the X direction, the intermediate gear 166, provided at the shaft 164, also moves in the X direction. The intermediate gear 162 that engages the intermediate gear 166 is supported by the arm member 220 that rotates. When the tracking roller 202 of the intermediate gear 166 and the tracking roller 204 of the intermediate gear 162 contact each other, the axial distance L2 (see FIGS. 9A and 9B) between the intermediate gear 162 and the intermediate gear 166 is maintained. Therefore, even if the intermediate gear 166 moves, the arm member 220 rotates, so that the axial distance L2 between the intermediate gear 162 and the intermediate gear 166 is maintained.

When the arm member 220 rotates and moves the intermediate gear 162, an axial distance L3 between the fixing-roller-side gear 158 and the intermediate gear 162 changes slightly. In the exemplary embodiments, when the external heating roller 108 shown in FIGS. 8A and 9B is at the contact position where it contacts the fixing roller 102, the external heating roller 108 is driven and rotated by the fixing roller 102. Therefore, in this state, as mentioned above, since, in the drive transmitting mechanism 200, the one-way clutch 168 rotates idly, and does not transmit driving force, even if engagement of the fixing-roller-side gear 158 and the intermediate gear 162 slightly deviates from that according to the design specification, problems do not occur. Consequently, the axial distance L3 is set so that the engagement between the fixing-roller-side gear 158 and the intermediate gear 162 when the external heating roller 108 is in the separation state shown in FIGS. 8B and 9A becomes the engagement according to the design specification.

Accordingly, in the exemplary embodiments, even if the external heating roller 108 moves in the direction X, the engagement of each gear remains the same, and the axial distances L1, L2, and L3 between the gears are maintained or substantially maintained.

When the gears come into contact with and separate from each other as the external heating roller 108 moves in the direction X, it is difficult to precisely determine the axial distances (engagement states).

In contrast, in the exemplary embodiments, as described above, even if the external heating roller 108 moves in the direction X, the engagements between the gears are maintained, so that the axial distances (engagement states) are more easily determined than in the structure in which the gears come into contact with and separate from each other. Therefore, it is possible to save space and to provide a highly reliable design.

Here, a comparative example that is compared with the exemplary embodiments will be described.

Figure 11A:
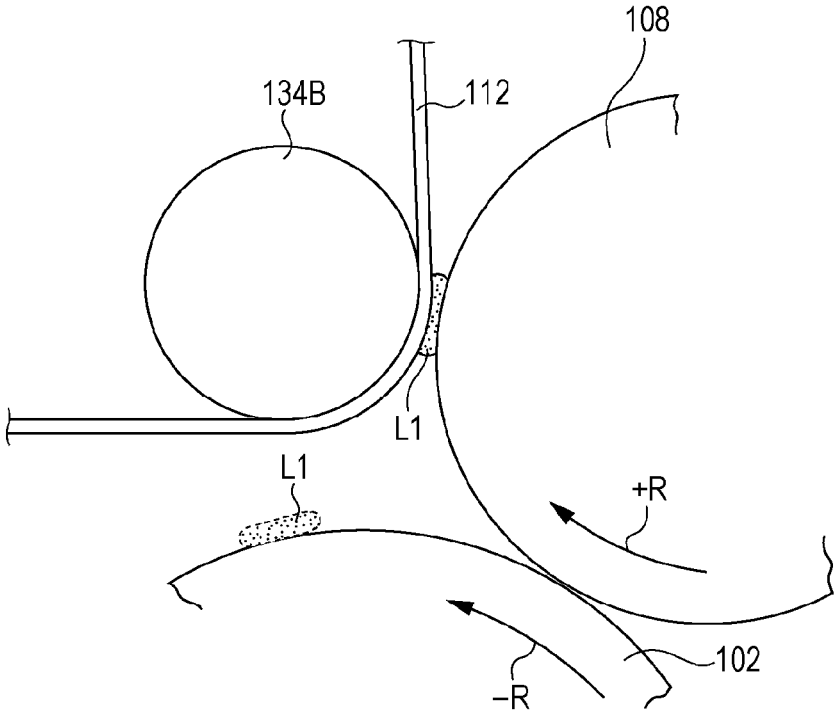
FIG. 11A is a schematic view of a fixing device according to a comparative example to which the present invention is not applied.

FIG. 11A shows the structure of a comparative example in which the external heating roller 108 is constantly caused to be in contact with the fixing roller 102 without using the retracting mechanical section 140 (see FIG. 8A, etc.). In the comparative example, when a fixing operation is not performed for a long time, oil coming out from the web 112 accumulates in a space between the external heating roller 108 and the web 112, as a result of which an oil accumulation L1 is formed. When the fixing operation is started, and the external heating roller 108 rotates, the oil accumulation L1 existing at the outer peripheral surface of the external heating roller 108 is moved to the outer peripheral surface of the fixing roller 102 at a portion where the external heating roller 108 contacts the fixing roller 102, and is transferred to recording paper P at a portion where the pressure roller 104 (see FIG. 3, etc.) contacts the fixing roller 102.

Figure 11B:
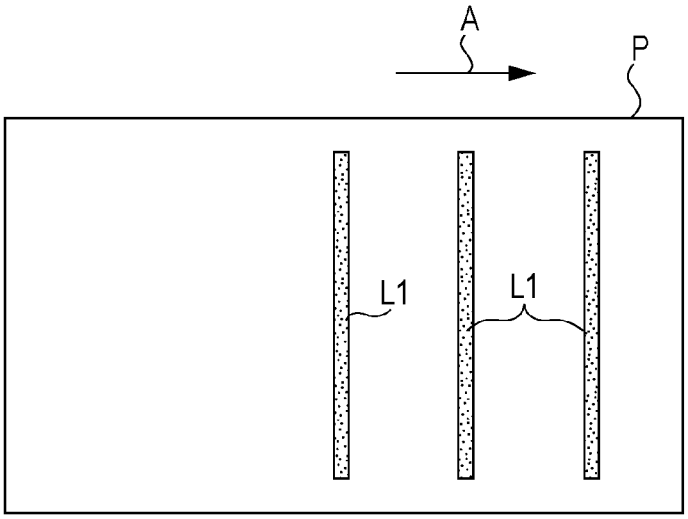
FIG. 11B illustrates a state in which oil marks are formed in the comparative example.

Therefore, as shown in FIG. 11B, the oil accumulation L1 remains as oil marks formed on the recording paper P at an interval corresponding to an outer peripheral length of the fixing roller 102.

Figure 10A:
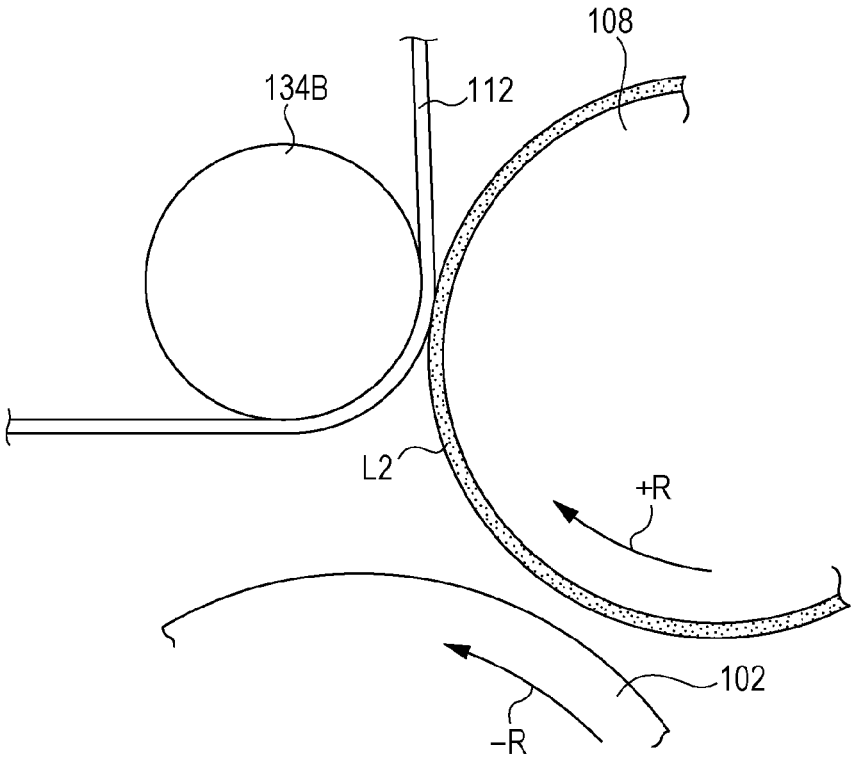
FIG. 10A is a schematic view of the fixing device according to the exemplary embodiment of the present invention.

In contrast, in the exemplary embodiments, as shown in FIG. 10A, prior to starting a fixing operation, the retracting mechanical section 140 (see FIG. 4, etc.) causes the external heating roller 108 to be at the separation position (refer to FIGS. 8B and 9A) where the external heating roller 108 is separated from the fixing roller 102. Then, when the fixing operation is started, and the fixing roller 102 rotates, driving force is transmitted to the external-heating-roller-side gear 174 (see FIG. 4, etc.) from the fixing-roller-side gear 158 through the intermediate gears 162, 166, and 172, thereby causing the external heating roller 108 to rotate. This causes the oil accumulation existing between the web 112 and the external heating roller 108 to be made uniform on the outer peripheral surface of the external heating roller 108, and become an oil layer L2.

Next, when, on the basis of a command from the controller 20 (see FIG. 1), the eccentric cam 148 (see FIG. 4) rotates and comes into contact with the bracket 144 (see FIG. 4), so that the external heating roller 108 is set at the contact position (see FIGS. 8A and 9B) where the external heating roller 108 contacts the fixing roller 102, as mentioned above, the one-way clutch 168 does not transmit driving force, and the external heating roller 108 is driven and rotated in accordance with the rotation of the fixing roller 102. At this time, the oil layer L2 existing along the outer peripheral surface of the external heating roller 108 is moved to the outer peripheral surface of the fixing roller 102 at a portion where the fixing roller 102 and the external heating roller 108 contact each other, and is transferred to recording paper P at a portion where the fixing roller 102 and the pressure roller 104 (see FIG. 3) contact each other.

Figure 10B:
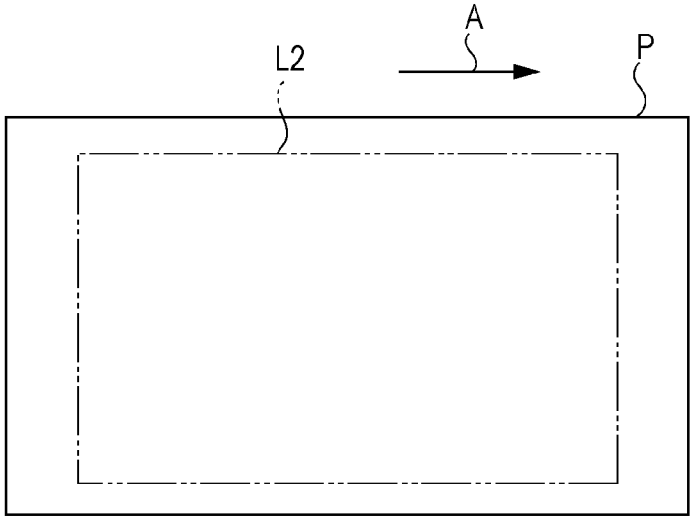
FIG. 10B illustrates a state in which oil marks are formed in the fixing device according to the exemplary embodiment of the present invention.

By this, as shown in FIG. 10B, the oil layer L2 that is uniformly formed is transferred to the recording paper P, thereby reducing oil marks on the recording paper and, thus, making it difficult to see the oil marks. After starting the fixing operation, the fixing roller 102 starts rotating, so that the external heating roller 108 rotates and comes into contact with the fixing roller 102. Therefore, compared to a structure in which the external heating roller 108 is brought into contact with the fixing roller 102 prior to the fixing operation by the fixing roller 102, unnecessary rotation of the fixing roller 102 is reduced. In addition, when the external heating roller 108 contacts the fixing roller 102, driving force is not transmitted to the external heating roller 108. Therefore, compared to a structure in which driving force is transmitted to the external heating roller 108 after the external heating roller 108 and the fixing roller 102 have come into contact with each other, a load that acts on the fixing roller 102 is reduced.

Other

The present invention is not limited to the above-described exemplary embodiments.

For example, in the exemplary embodiments, transmission and non-transmission of driving force from the fixing roller 102 to the external heating roller 108 are not limited to being carried out using the one-way clutch 168. They may be performed using, for example, an electromagnetic clutch. Alternatively, it is possible to transmit and not to transmit driving force by moving, for example, a pin. The electromagnetic clutch, the pin, etc., that is, the transmission and the non-transmission of driving force are controlled by the controller 20.

For example, in the exemplary embodiments, the external heating roller 108 is formed so that, even if the external heating roller 108 is moved in the X direction, the axial distances between the gears are maintained or substantially maintained. However, when the external heating roller 108 is driven and rotated, it is not necessary to transmit driving force using gears. Therefore, no problems occur even if the axial distances between the gears in this case slightly deviate from those according to the design specification. Consequently, when the external heating roller 108 is at the separation position (that is, when transmission of driving force by the gears is required), the axial distances between the gears are set so as to fall within a range according to the design specification.

In addition, for example, the fixing roller 102 may be a fixing belt that is heated by electromagnetic induction. Further, as another exemplary embodiment, it is possible to rotate an oil applying roller before the oil applying roller contacts the fixing roller 102 in a structure in which the oil applying roller contacts the fixing roller 102. In the oil applying roller, a contact member and an oil supplying unit are integrated to each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that is rotated by a driving unit and that fixes a developer image on a recording medium;

an external heating member that is driven and rotated while contacting an outer peripheral surface of the fixing member, and that heats the fixing member;

a moving unit that moves the external heating member between a separation position, where the external heating member is separated from the outer peripheral surface of the fixing member, and a contact position, where the external heating member contacts the outer peripheral surface of the fixing member, the moving unit moving the external heating member from the separation position to the contact position after starting the fixing by the fixing member;

a drive transmitting mechanism including a fixing-side gear, an external-heating-member-side gear, and a drive transmitting member that transmits a driving force between the fixing-side gear and the external-heating-member-side gear, the external-heating-member-side gear being provided at the external heating member; and a driving force transmitting/non-transmitting unit that is provided at the drive transmitting mechanism, the driving force transmitting/non-transmitting unit transmitting the driving force from the fixing-side gear to the external-heating-member-side gear so that the external heating member rotates when the external heating member is at the separation position, the driving force transmitting/non-transmitting unit not transmitting the driving force from the fixing-side gear to the external-heating-member-side gear so that the external heating member is driven and rotated by the fixing member when the external heating member is at the contact position.

2. The fixing device according to claim 1, wherein, in the drive transmitting mechanism, there is a difference between a speed at a surface of the external heating member and a speed at a surface of the fixing member when the drive transmitting mechanism transmits the driving force to both the external heating member and the fixing member, and wherein the driving force transmitting/non-transmitting unit is a turning force transmitting unit that is provided at one of the two gears, that rotates idly due to different rotational speeds, and that transmits a turning force in only one direction.

3. The fixing device according to claim 1, comprising the fixing member that is rotated by the driving unit and that fixes the developer image on the recording medium;

the external heating member that is driven and rotated while contacting the outer peripheral surface of the fixing member, and that heats the fixing member;

an oil supplying unit that supplies oil to a surface of the external heating member;

the moving unit that moves the external heating member between the separation position, where the external heating member is separated from the outer peripheral surface of the fixing member, and the contact position, where the external heating member contacts the outer peripheral surface of the fixing member, the moving unit moving the external heating member from the separation position to the contact position after starting the fixing by the fixing member;

the drive transmitting member including the fixing-side gear, the external-heating-member-side gear, and a plurality of gears that transmit the driving force between the fixing-side gear and the external-heating-member-side gear, the plurality of gears contacting the fixing-side gear or the external-heating-member-side gear even if the external heating member moves between the contact position and the separation position; and the driving force transmitting/non-transmitting unit that is provided at the drive transmitting mechanism, the driving force transmitting/non-transmitting unit transmitting the driving force from the fixing-side gear to the external-heating-member-side gear so that the external heating member rotates when the external heating member is at the separation position, the driving force transmitting/non-transmitting unit not transmitting the driving force from the fixing-side gear to the external-heating-member-side gear so that the external heating member is driven and rotated by the fixing member when the external heating member is at the contact position.

4. The fixing device according to claim 3, wherein, in the drive transmitting mechanism, there is a difference between a speed at a surface of the external heating member and a speed at a surface of the fixing member when the drive transmitting mechanism transmits the driving force to both the external heating member and the fixing member, and wherein the driving force transmitting/non-transmitting unit is a turning force transmitting unit that is provided at one of the two gears, that rotates idly due to different rotational speeds, and that transmits a turning force in only one direction.

5. The fixing device according to claim 3, comprising the fixing member that is rotated by the driving unit and that fixes the developer image on the recording medium;

the external heating member that is driven and rotated while contacting the outer peripheral surface of the fixing member, and that heats the fixing member;

an oil supplying unit that supplies oil to a surface of the external heating member;

the moving unit that moves the external heating member between the separation position, where the external heating member is separated from the outer peripheral surface of the fixing member, and the contact position, where the external heating member contacts the outer peripheral surface of the fixing member, the moving unit moving the external heating member from the separation position to the contact position after starting the fixing by the fixing member;

the drive transmitting mechanism including the fixing-side gear, the external-heating-member-side gear, and the drive transmitting member that transmits the driving force between the fixing-side gear and the external-heating-member-side gear, the external-heating-member-side gear being provided at the external heating member; and the driving force transmitting/non-transmitting unit that is provided at the drive transmitting mechanism, the driving force transmitting/non-transmitting unit transmitting the driving force from the fixing-side gear to the external-heating-member-side gear so that the external heating member rotates when the external heating member is at the separation position, the driving force transmitting/non-transmitting unit not transmitting the driving force from the fixing-side gear to the external-heating-member-side gear so that the external heating member is driven and rotated by the fixing member when the external heating member is at the contact position.

6. An image forming apparatus comprising:

a developer image forming unit that forms the developer image on the recording medium; and the fixing device according to claim 1 that fixes the developer image formed by the developer image forming unit to the recording medium.

7. An image forming apparatus comprising:

a developer image forming unit that forms the developer image on the recording medium; and the fixing device according to claim 2 that fixes the developer image formed by the developer image forming unit to the recording medium.

* * * * *